United States Patent [19]

Thompson

[11] 4,019,742

[45] Apr. 26, 1977

[54] BOARD GAME APPARATUS

[76] Inventor: Lee W. Thompson, 42 Westbury Ave., Plainview, N.Y. 11803

[22] Filed: Dec. 24, 1975

[21] Appl. No.: 644,216

[52] U.S. Cl. ..... 273/134 CA; 273/134 C

[51] Int. Cl.[2] ..... A63F 3/00

[58] Field of Search ..... 273/131, 134

[56] References Cited

UNITED STATES PATENTS

| | | | |
|---|---|---|---|
| 1,493,738 | 5/1924 | Cowan | 273/134 CH |
| 1,797,742 | 3/1931 | Ward | 273/134 AG |
| 3,057,623 | 10/1962 | Barnes | 273/134 CH |
| 3,462,151 | 8/1969 | Parisi | 273/134 CH |

FOREIGN PATENTS OR APPLICATIONS

| | | | |
|---|---|---|---|
| 1,275,511 | 10/1961 | France | 273/134 CA |
| 764,210 | 12/1956 | United Kingdom | 273/134 CA |

*Primary Examiner*—Delbert B. Lowe
*Attorney, Agent, or Firm*—Nolte and Nolte

[57] ABSTRACT

A board game simulating racing events comprising a board imprinted with a design indicating at least one course for a racing event and starts and finishes of the courses, indicia along courses on the board indicating simulated units of time, the indicia also extending beyond the finishes of the courses, pieces representing racers to be moved along the courses and means for selecting by chance the number of indicia a piece is to be moved along the course, is played by directing each player to select a predetermined number of cards giving the number of indicia the player's piece is to be moved along the course and then calculating the simulated time the player's piece took to traverse the course on the basis of a predetermined time from the start to the finish of the course and a predetermined quantity of time per indicia by which the player's piece fell short of or passed the finish after the player had drawn the predetermined number of cards and moved his piece in accordance therewith, time being added to the predetermined time for the course if the player's piece fell short of the finish and being subtracted from the predetermined time for the course if the player's piece passed the finish and being equal to the predetermined time for the course if the player's piece finally landed exactly on the finish.

2 Claims, 2 Drawing Figures

BOARD GAME APPARATUS

BACKGROUND OF THE INVENTION

This invention relates to a board game and to a method of playing the same.

More particularly, the game and method of the invention is generally characterized by the fact that simulated race courses imprinted on the board are marked with indicia which represent simulated units of time.

According to one aspect of the invention, there is provided a board game simulating racing events comprising a board imprinted with a design indicating at least one course for a racing event and starts and finishes of the courses, indicia along each course indicating simulated units of time, the indicia also extending beyond the finishes of the courses, pieces representing racers to be moved along the courses and means for selecting by chance the number of indicia a piece is to be moved along the course. In preferred embodiments, the selecting means is a set of cards marked with integers for indicating a number of indicia a piece is to be moved. Alternatively, the selecting means may be other means, such as a spinner. Preferably, the game also includes a second set of cards marked with integers from 1 to 9 indicating respective tenths of a second, the indicia on the board indicating integral numbers of seconds.

Most preferably, in the board game there are a plurality of courses imprinted on at least one board and each of the courses represents a winter olympics sporting event, in most instances a racing event.

The hereinabove described type of game is played by directing each player to place a piece at the start of a course, directing the players to draw a predetermined number of cards and move their pieces along the course a number of indicia according to the numbers appearing on the cards, and directing each player at the conclusion of his selecting the total number of cards allowed for the course to calculate the time his piece is considered to have expended in traversing the course by starting with a predetermined fixed time considered to be elapsed from start to finish of the course and adding to or substracting from that time a quantity of time calculated by multiplying the number of indicia by which his piece fell short of the finish or passed the finish, respectively, by a predetermined quantity of time per indicia. The predetermined quantity of time will generally be a predetermined integral number of seconds. Of course, if a player's piece happens to be exactly on the finish at the conclusion of his drawing and moving his piece according to the total number of cards allowed, then the time his piece is considered to have expended in traversing the course is exactly the predetermined fixed base time for the course.

Preferably, a second set of cards is provided each marked with one of the integers 1 to 9. Cards are drawn from the second set at the conclusion of the race, particularly when there is a tie, to determine tenths of seconds for the time elapsed by each of the pieces.

When the game includes at least one board imprinted with a plurality of courses representing, for example, various events of the winter olympics, the players are directed to traverse each of the courses according to the foregoing procedure, the players are also directed to score a predetermined number of points for each course depending upon their order of finish and the players are finally directed to declare the player thus accumulating the greatest number of points the winner of the entire game, for example, the winter olympics, in which latter case each player may be considered to be a predetermined particular country competing in the winter olympics.

BRIEF DESCRIPTION OF THE DRAWINGS

The invention will now be further described by reference to the specific embodiments, as illustrated in the drawings, in which.

DESCRIPTION OF THE PREFERRED EMBODIMENTS

Figure 1:
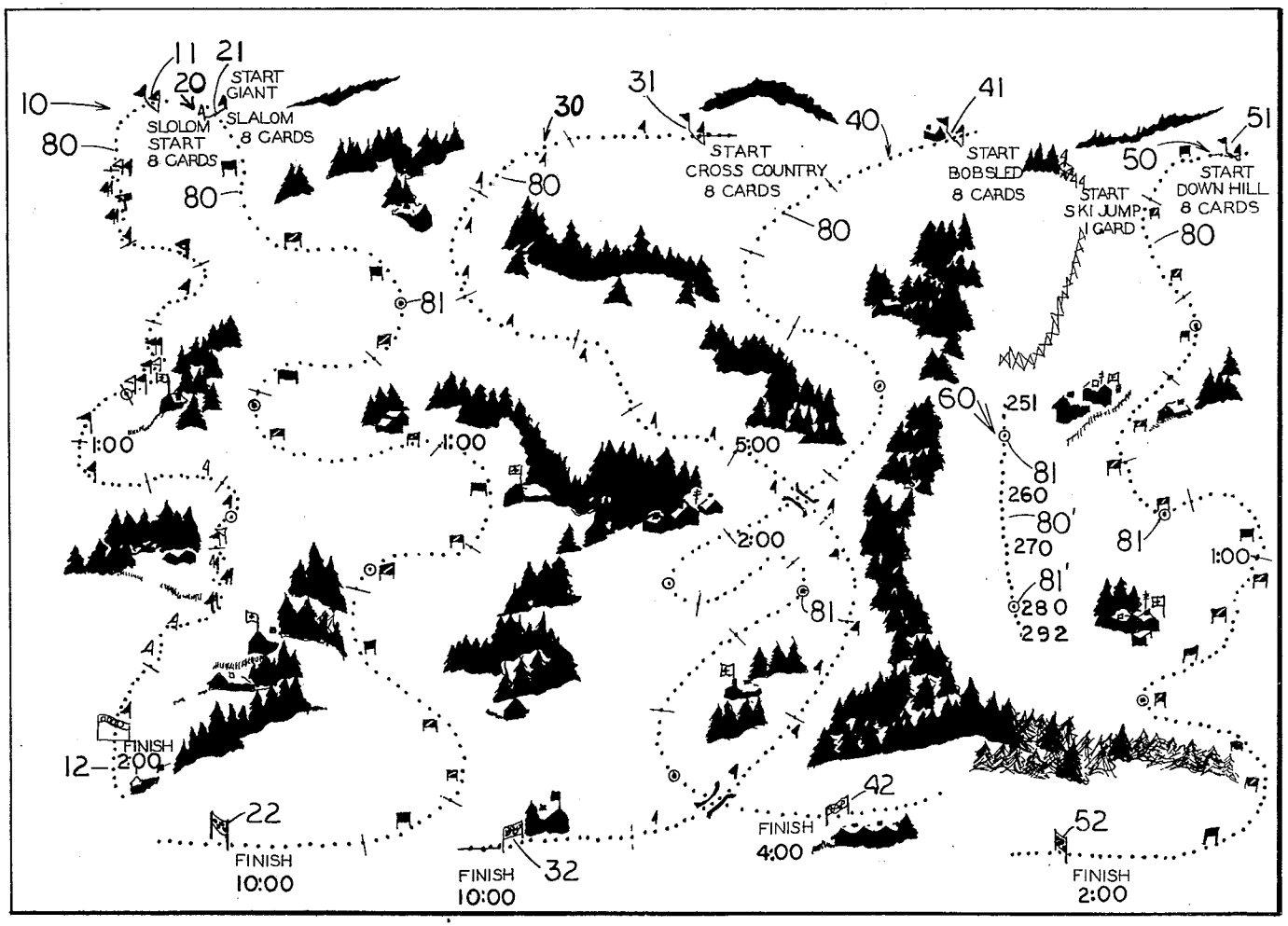
FIG. 1 is a plan view of a board for the game imprinted with courses for a number of skiing events.

Turning now to FIG. 1, the board is imprinted with a slalom course 10 having a start 11 and a finish 12, a giant slalom course 20 having a start 21 and a finish 22, a cross country skiing course 30 having a start 31 and a finish 32, a bob sled course 40 having a start 41 and a finish 42 and a downhill skiing course 50 having a start 51 and a finish 52. There is also a ski jump course 60. Unlike the other courses in the game, the ski jump course 60 is marked in simulated units of space rather than simulated units of time. In particular, the simulated units of space are individual feet from 251 feet to 292 feet, each indicia representing one foot. The cards which are marked with the number of indicia the piece is to be moved on the other courses may also be, for example, in a corner, marked with a number between 251 and 292 to indicate how far a player's piece is considered to have jumped when the player draws a card.

Figure 2:
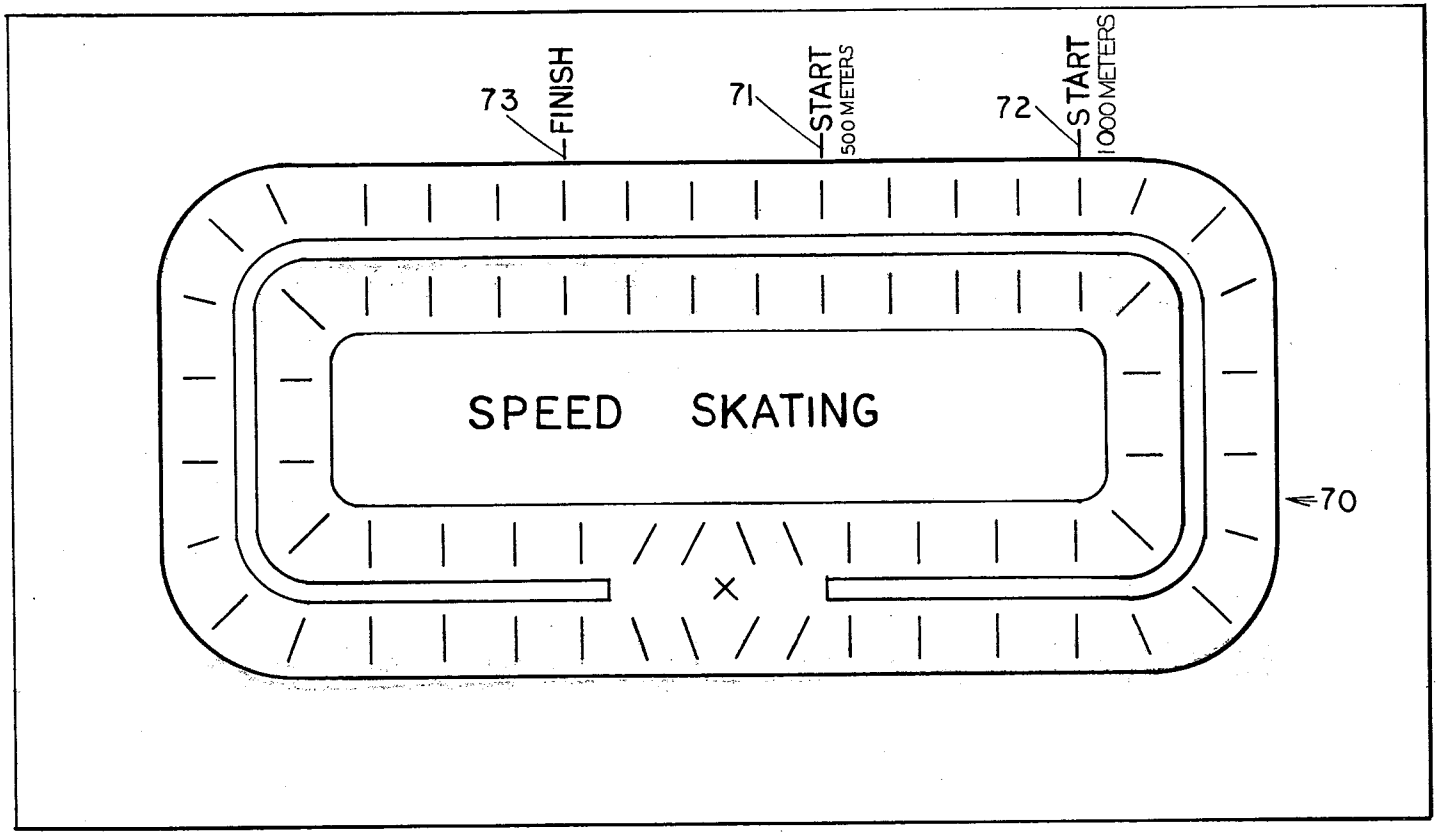
FIG. 2 is a plan view of a board for the game imprinted with a speed skating race course.

A second board, illustrated in FIG. 2, is provided to include speed skating in the game. For this purpose, a speed skating course 70 having a start 71 for a 500 meter race, a start 72 for a 1,000 meter race and a finish 73 is provided.

The main deck of cards for the game includes 32 cards, four each with the respective integers from 10 to 17. A second deck of cards with, for example, four cards each with the integers 1 to 9 is used for determining tenths of seconds. By referring to the board of FIG. 1 it will be seen that for the course 10, eight cards are to be used and the base elapsed time from start to finish is 2 minutes. For course 20 the respective figures are eight cards and 10 minutes, for course 30 eight cards and 10 minutes, for course 40 eight cards and 4 minutes, for course 50 eight cards and 2 minutes. Each of the indicia 80 on courses 10, 20, 30, 40 and 50 represent the number of seconds determined by dividing the base total time elapsed from start to finish of the course by the number of indicia that one must move upon in traversing from start to finish of the course. Some of the indicia 81 on each course are encircled. If a player's piece happens to land on such an indicia 81 after he has moved the piece the number of indicia indicated by a card he has drawn, he is considered to have had an accident which prevents him from completing the race at that point. The course 60 is marked with primary indicia 80' and accident indicia 81', the difference from the respective indicia 80 and 81 for the other courses simply being that the indicia for the course 60 are for feet rather than for simulated units of time.

Running a race along any of the courses 10, 20 30, 40 and 50 can readily be understood by reference to one.

For example, consider the slalom 10. Assume there are a player A and a player B. Player A and player B place their respective pieces at the start 11 of the slalom. They each pick eight cards and they move their pieces a number of indicia corresponding to the numbers on the cards. The deck of cards they select from is the aforementioned deck of cards in which the numbers imprinted on the cards are from 10 to 17. After each of the players has selected the eight cards and moved his piece, it is found that player A's piece is 3 indicia short of the finish line and player B's piece is 3 indicia past the finish line. There are 120 indicia from start to finish. This means that each indicia represents one second. Consequently, player A's time is calculated at 2 minutes, the base time for the course, plus 3 seconds for a total of 2 minutes and 3 seconds, whereas player B's time is calculated at 2 minutes less 3 seconds, for a total of 1 minute and 57 seconds. For the sake of greater realism or to break a tie, at this point each player may pick from the deck of cards representing tenths of seconds in order to add that to his time. How the ski jump 60 is played has been mentioned above. With regard to the speed skating on the track 70 of FIG. 2, the pieces are moved clockwise, there being provided two parallel tracks with indicia for the competing racers. There is a single finish line 73 and respective separate starting lines 71 for the 500 meter race and 72 for the 1,000 meter race. For the 500 meter race, three cards are drawn and for the 1,000 meter race six cards are drawn. Each indicia represents one second. Hence, the speed skating is exactly analogous to the other racing events except that for the sake of realism the course is closed and the players draw cards alternately to simulate simultaneous movement around the course rather than each in turn drawing all his cards as in the case of the skiing and bobsled races which, as actually run, are races against the clock rather than between simultaneous competitors. For more than two players in the speed skating, the players may run against each other in pairs until all the players have had a turn or the board may be provided with an increased number of parallel tracks.

In simulating a winter olympics, in each event points would be awarded the player in accordance with the order in which he finished. For example, first place — ten points (Gold Medal), second place — five points (Silver Medal), third place — four points (Bronze Medal), fourth place — three points, fifth place — two points, sixth place — one point and lower positions no points. If a tie should occur for one of the positions for which points are awarded, both contestants would receive the correct number of points for finishing in that position and the following finisher would be moved down to the next order of finish. For example, should two players finish first, both would receive ten points and the contestant to finish second would be removed to third place and receive four points instead of five points. At the end of all events, each player's points are tallied and the one with the greatest number of points is the winner of the winter olympics.

What is claimed is:

1. A board game simulating racing events comprising a board imprinted with a design indicating at least one course for a racing event and starts and finishes of the courses, indicia along each course indicating simulated units of time, said indicia also extending beyond the finishes of the courses, pieces representing racers to be moved along the courses and means for selecting by chance the number of indicia a piece is to be moved along the course, said selecting means comprising a first set of cards marked with integers for indicating the number of indicia on a course a piece is to be moved and a second set of cards marked with integers from 1 to 9 indicating respective tenths of a second.

2. A board game according to claim 1, in which a plurality of courses is imprinted on the board and each of the courses represents a winter olympics sporting event.

* * * * *